US006068087A

United States Patent [19]

Moncini

[11] Patent Number: 6,068,087

[45] Date of Patent: May 30, 2000

[54] BELT-CLIMBING ELEVATOR HAVING DRIVE IN COUNTERWEIGHT AND COMMON DRIVE AND SUSPENSION ROPE

[75] Inventor: Ray Moncini, Southington, Conn.

[73] Assignee: Otis Elevator Company, Farmington, Conn.

[21] Appl. No.: 09/163,587

[22] Filed: Sep. 30, 1998

[51] Int. Cl.[7] ..... B66B 11/04

[52] U.S. Cl. ..... 187/252; 187/250; 187/411; 254/333

[58] Field of Search ..... 187/250, 252, 187/404, 262, 412, 411, 251; 254/333

[56] References Cited

U.S. PATENT DOCUMENTS

| | | | |
|---|---|---|---|
| 975,790 | 11/1910 | Pearson | 187/254 |
| 2,405,691 | 8/1946 | Ellis . | |
| 3,101,130 | 8/1963 | Bianca | 187/404 |
| 4,570,753 | 2/1986 | Ohta et al. | 187/1 |
| 5,062,501 | 11/1991 | Pavoz et al. | 187/112 |
| 5,566,785 | 10/1996 | Hakala | 187/250 |
| 5,573,084 | 11/1996 | Hakala | 187/252 |

FOREIGN PATENT DOCUMENTS

| | | |
|---|---|---|
| 0 565 516 | 4/1993 | European Pat. Off. . |
| 0631969 | 6/1994 | European Pat. Off. . |
| 2333120 | 1/1975 | Germany . |
| 3834790 A1 | 10/1988 | Germany . |
| 1 401 197 | 6/1972 | United Kingdom . |
| PCT/FI97/ 00823 | 12/1997 | WIPO . |
| PCT/FI97/ 00824 | 12/1997 | WIPO . |

OTHER PUBLICATIONS

"Hannover Fair: Another new idea from ContiTech—Lifting belts for elevators", ContiTech initiativ Jan. 1998 (Hannover Fair '98).

*Primary Examiner*—Robert P. Olszewski
*Assistant Examiner*—Thuy V. Tran

[57] ABSTRACT

An elevator system includes a counterweight-drive assembly (24) having a motor and drive pulley (26) mounted thereon to engage a belt (16) for climbing or descending with respect thereto, resulting in raising or lowering of an elevator car (12) coupled to said counterweight-drive assembly (26) via the same belt (16).

9 Claims, 2 Drawing Sheets

BELT-CLIMBING ELEVATOR HAVING DRIVE IN COUNTERWEIGHT AND COMMON DRIVE AND SUSPENSION ROPE

TECHNICAL FIELD

The present invention relates to elevator systems and, more particularly, to an elevator system requiring less installation and operation space than conventional elevator systems by utilizing combined function structures including a counterweight-drive assembly and a belt that shares drive belt and suspension rope functions.

BACKGROUND OF THE INVENTION

Known elevator systems typically confine all elevator components to the hoistway or the machine room. The hoistway is an elongated, vertical shaft having a rectangular base in which the elevator car translates. The hoistway houses, among other things, the car guide rails which are usually a pair of generally parallel rails, fixed to opposite walls near the center of each wall, and running the approximate length of the hoistway. A counterweight having a pair of guide rails is positioned adjacent to a third wall. The hoistway houses additional components including terminal landing switches, ropes and sheave arrangements, and buffers for the counterweight and the car.

It is essential that the elevator components are located and oriented with precision prior to and during operation. The interior walls of the hoistway must be properly dimensioned and aligned, and the physical interface between the hoistway walls and the elevator components must be capable of withstanding varying load during use. It is particularly essential that the guide rails on which the car rides are properly positioned and solidly maintained. For quality of ride and safety, the guide rails need to be precisely plumb, square and spaced to avoid car sway, vibration and knocking. Guide rails are typically steel, T-shaped sections in sixteen foot lengths. The position of guide rails within the hoistway affects the position of the hoisting machine, governor and overhead (machine room) equipment. The machine room is typically located directly above the hoistway. The machine room houses the hoist machine and governor, the car controller, a positioning device, a motor generator set, and a service disconnect switch.

Because the various components of the hoistway and machine room require precise positioning and they produce varying and substantial loads, it is costly and complicated to assemble a typical traction elevator system.

OBJECTS AND SUMMARY OF THE INVENTION

It is an object of the present invention to provide an improved elevator system that optimizes use of space by providing a multi-function component that functions as a counterweight and a support for the drive machine and system, so that the need for a machine room and other space-consuming components is eliminated. It is a further object to provide an improved elevator system that achieves optimum efficiency in construction and materials by various means including, for example, providing a counterweight apparatus that stores potential energy as an integral part of the lift arrangement and that reduces the required torque for movement of the elevator car. It is a further object of the present invention to provide an elevator system having a self-climbing counterweight-drive assembly that uses a common, shared belt for the drive belt and for suspending the elevator car.

The present invention achieves the aforementioned and other objects by utilizing an assembly of a drive machine and components housed within and moveable with a counterweight, as well as a shared rope or belt which functions both as a drive belt and as a suspension rope. The counterweight-drive assembly includes a motor and drive pulley sized to maintain a narrow profile and to be suspended and to move in coordination with an elevator car. The use of flat ropes or belts reduces the size of the traction sheave and motor required such that the machine can have a narrow profile, enabling a machine-counterweight assembly to fit between the elevator car and the hoistway wall. As used herein, the term "flat ropes" refers to ropes or belts having an aspect ratio of greater than one, where aspect ratio is defined as the ratio of the rope or belt width to the thickness. The counterweight-drive assembly is coupled to an elevator car by being suspended from the same belt or rope which is fixed relative to the hoistway at both ends. When torque is applied through the drive pulley, the counterweight-drive assembly is caused to climb the belt and move up or down the hoistway. It is preferable to use a flat belt or rope for optimum traction and low weight.

DESCRIPTION OF THE PREFERRED EMBODIMENTS

Figure 1:
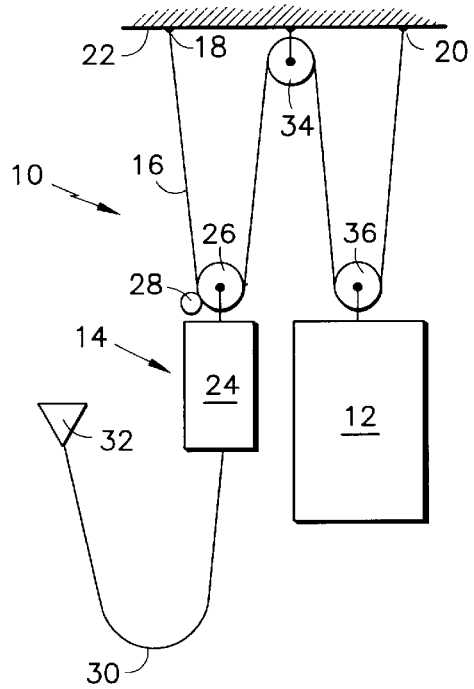
FIG. 1 is a schematic view of the present invention elevator assembly showing the elevator car and the counterweight drive assembly at a common height.
Figure 2:
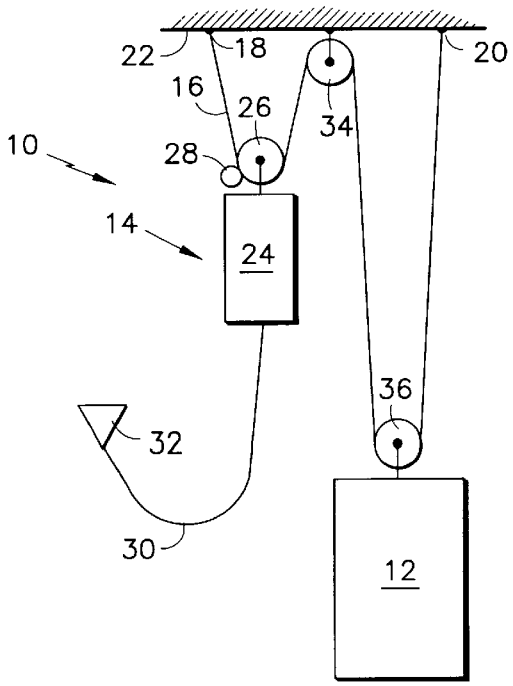
FIG. 2 is a schematic view of the elevator assembly as shown in FIG. 1 showing the elevator car in a lowered position and the counterweight-drive assembly in a raised position.
Figure 3:
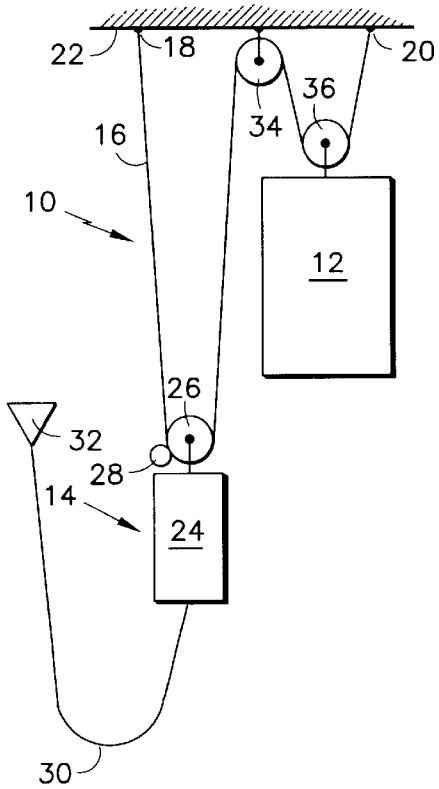
FIG. 3 is a schematic view of a component of the elevator assembly of FIG. 1 showing the elevator car in a raised position and the counterweight-drive assembly in a lowered position.

An elevator assembly according to the present invention is illustrated schematically in FIGS. 1–3. An elevator assembly (10) includes an elevator car (12) and a counterweight-drive assembly (14), each being suspended from a belt (16) which is fixed at first (18) and second (20) ends to a hoistway ceiling surface (22) or other fixed structure. The counterweight-drive assembly (14) comprises a body (24) housing a drive assembly (not shown) including a motor. Components of the drive assembly include a drive pulley (26) adapted to provide torque from the motor, and a brake mechanism (28). The motor can be an electric motor and can be supplied power and control signals via a power and control cable (30) in communication with a power and control source (32). The cable (30) is adapted to move with the counterweight-drive assembly (24).

Figure 4:
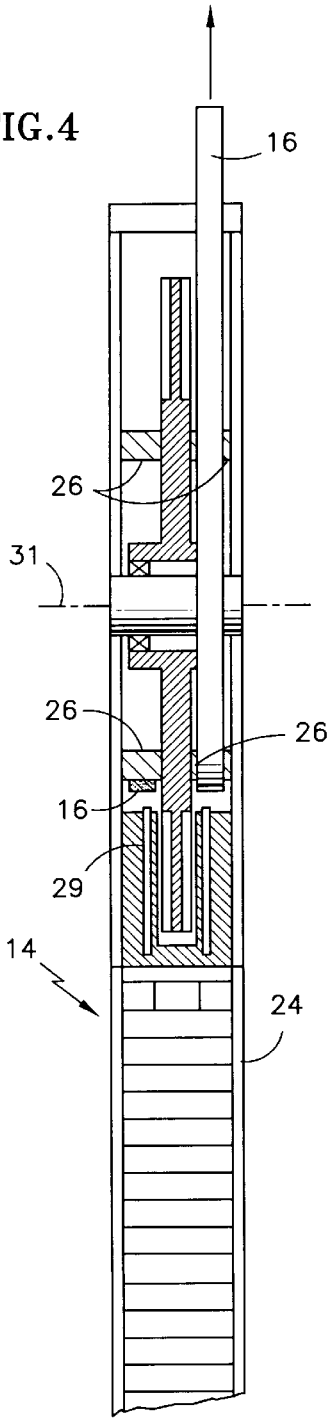
FIG. 4 is a side view of the counterweight and drive assembly, partially cut away to illustrate the belt and disc-type machine.
Figure 6:
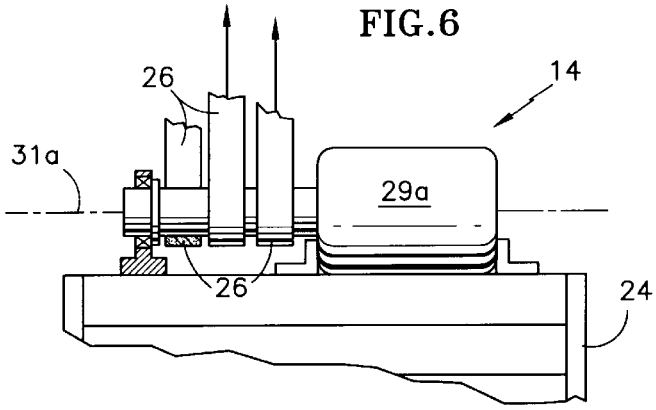
FIG. 6 is a view taken along line 6—6 of FIG. 5.
Figure 5:
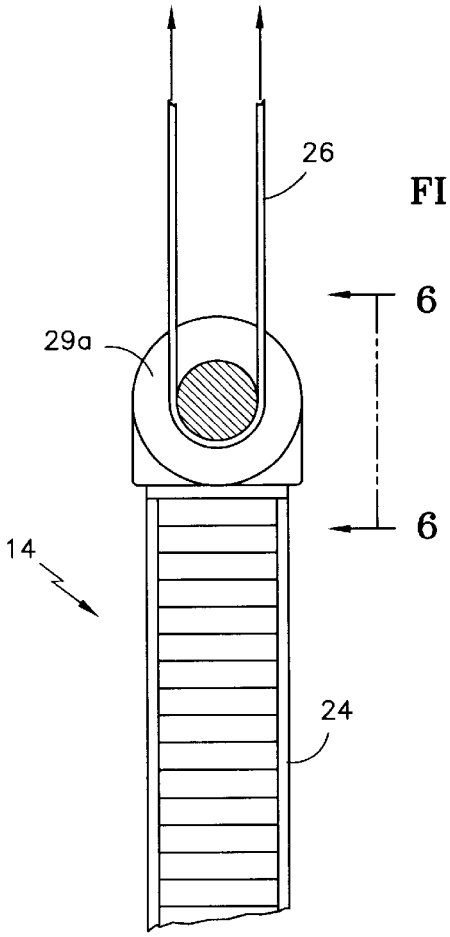
FIG. 5 is a side view of an alternate embodiment having a counterweight and drive assembly including a cylindrical machine.

The motor (29), as seen in FIG. 4, is preferably of the flat machine type having, for example, a disc-type rotor (33) with the rotational axis (31) of the machine perpendicular to the width of the counterweight. The use of flat ropes with this type of machine minimizes torque requirements of the motor and therefore minimizes the diameter of the disc-type rotor. This enables the counterweight and machine to fit between the car (12) and the hoistway wall. Alternatively, a cylindrical machine (29*a*) as seen in FIGS. 5 and 6, may be used in which the rotational axis (31*a*) is parallel to the width of the counterweight. With this type of motor, the use of flat ropes minimizes the overall volume of the motor required so that it can fit within the space between the car (12) and the hoistway wall.

A first idler pulley (34) is fixed to the hoistway ceiling (22) or other stationary surface and pivotally engages the belt (16). A second idler pulley (36) is fixed to the elevator car (12) and also pivotally engages the belt (16).

In operation, when the motor is energized, torque is transferred through the drive pulley (26) to the belt (16) such that the counterweight-drive assembly (24) will move along and relative to the belt (16). The counterweight-drive assembly (24) can be stopped and fixed relative to the belt (16) in a selected position by activating the braking mechanism (28). The counterweight-drive assembly (24) will selectively move up or down depending on the direction of rotation of the drive pulley (26).

When the counterweight-drive assembly (24) is caused to move toward the first end (18) of the belt (16), as shown in FIG. 2, the length of belt (16) between the drive pulley (26) and the first end (18) is shortened, and the remaining length between the drive pulley (26) and the first idler pulley (34) will shorten to maintain tension in the belt between the first idler pulley (34) and the first end (18). As a result, the length of belt (16) between the first idler pulley (34) and the second end (20) of the belt (16) will increase as gravity acts on the elevator car (12). After the braking mechanism (28) is applied, the counterweight-drive assembly (24) will stop moving and the elevator car (12) will settle in an equilibrium position as shown.

To raise the elevator car (12), as shown in FIG. 3, the counterweight-drive assembly (24) is caused to move away from the first end (18) of the belt (16). The length of belt (16) between the drive pulley (26) and the first end (18) is increased and, due to gravity, the counterweight-drive assembly (24) will lower. As a result, the length between the drive pulley (26) and the first idler pulley (34) will also increase as the belt (16) passes freely over the first idler pulley (34). At the same time, the length of belt (16) between the first idler pulley (34) and the second end (20) of the belt (16) will decrease and cause the elevator car (12) to be raised. After the braking mechanism (28) is applied, the counterweight-drive assembly (24) will stop moving and the elevator car (12) will settle in an equilibrium position as shown.

It is understood that while the preferred embodiment contemplates the belt (16) being a flat one for high traction, the belt may be of a variety of different suitable types including a toothed belt. Furthermore, the configuration of the drive mechanism contained in the counterweight-drive assembly (24) may vary in such ways as using a plurality of motors or drive pulleys or sheaves. Other modifications of similar type can be implemented in the present invention without departing from the scope of what is presently claimed.

As can be seen from the foregoing description of the preferred embodiment, the present invention eliminates the need for a machine room, requires less total material, and enables use of small diameter drive pulley and idler pulleys with a high-traction flat rope or belt. The machine or drive assembly (24) can be accessed either from the bottom of the hoistway or through a window or opening in the elevator car (12) when positioned in alignment. The design of the present invention eliminates body-conducted vibrations and noise from the motor to the car (12) or building. The flat belt (16) inherently dampens vibrations. The counterweight-drive assembly (24) may be pre-assembled and pre-tested to save on installation time and to increase reliability.

I claim:

1. An elevator system comprising a belt having at least one end fixed relative to an elevator hoistway, the belt having an aspect ratio of greater than one, wherein aspect ratio is defined as the ratio of the belt width to the thickness;

a counterweight-drive assembly suspended by said belt and having drive means for engaging said belt in traction and driving said counterweight-drive assembly relative to said belt; and an elevator car suspended by said belt and having belt engaging means for engaging said belt, whereby when said counterweight-drive assembly is driven relative to said belt, said elevator car is moved in response thereto.

2. An elevator system according to claim 1, wherein said belt engaging means comprise at least one idler pulley fixed to said elevator car and adapted to receive said belt.

3. An elevator system according to claim 1, wherein said belt is a flat rope.

4. An elevator system according to claim 1, wherein said drive means include an electric motor and a traction drive pulley.

5. An elevator system according to claim 1, wherein said drive means include a braking member for selectively braking said drive means.

6. An elevator system comprising a flat rope having at least one end fixed relative to an elevator hoistway;

a counterweight-drive assembly having drive means for engaging said rope in traction and driving said counterweight-drive assembly relative to said rope; and an elevator car having rope engaging means for engaging said rope, whereby when said counterweight-drive assembly is driven relative to said rope, said elevator car is moved in response thereto.

7. An elevator system according to claim 6, wherein said rope engaging means comprises an idler pulley.

8. An elevator system according to claim 6, wherein said counterweight-drive assembly has a width and comprises a rotor having a rotational axis perpendicular to the width of said counterweight-drive assembly.

9. An elevator system according to claim 6, wherein said counterweight-drive assembly has a width and a rotational axis parallel to the width of said counterweight-drive assembly.

* * * * *